US007076180B1

(12) United States Patent
Huang et al.

(10) Patent No.: US 7,076,180 B1
(45) Date of Patent: Jul. 11, 2006

(54) TONER CARTRIDGE

(75) Inventors: Ya-Li Huang, Taichung (TW); Ren-Hao Liu, Taichung (TW); Chin-His Chuang, Changhua (TW); Kuan-Tung Li, Yunlin (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 11/135,476

(22) Filed: May 24, 2005

(51) Int. Cl.
*G03G 15/08* (2006.01)

(52) U.S. Cl. ..... 399/27; 399/263

(58) Field of Classification Search ..... 399/262, 399/27, 263
See application file for complete search history.

(56) References Cited

U.S. PATENT DOCUMENTS 5,260,750 A * 11/1993 Ishida et al. ..... 399/262
6,546,213 B1 * 4/2003 Ito et al. ..... 399/27
6,654,569 B1 * 11/2003 Nozawa ..... 399/27
6,892,036 B1 * 5/2005 Ito ..... 399/27
2004/0264984 A1 * 12/2004 Yabuki et al. ..... 399/27

* cited by examiner

*Primary Examiner*—David M. Gray
*Assistant Examiner*—Lauren J. Daniel
(74) *Attorney, Agent, or Firm*—Browdy and Neimark, PLLC

(57) ABSTRACT

A toner cartridge includes a housing, which has a first chamber and a second chamber, a rotary member mounted in the first chamber and rotatable relative to the housing by an external rotary driving force, a first magnet fixedly fastened to the rotary member, an axial motion member mounted in the second chamber, and a second magnet, which is fixedly provided at the bottom side of the axial motion member for acting with the first magnet to force the axial motion member to reciprocate.

8 Claims, 7 Drawing Sheets

TONER CARTRIDGE

BACKGROUND OF THE INVENTION

1. Field of the Invention

The present invention relates to an electronic image forming apparatus and more specifically, to a toner cartridge for use in an electronic image forming apparatus that is easy to install and effectively prevents a false action.

2. Description of the Related Art

FIG. 1 shows a toner cartridge for use in an electronic image forming apparatus according to the prior art. According to this design, the toner cartridge 1 has a rotary member 4 mounted inside the housing 3 and rotatable relative to the housing 3 by an external rotary driving force. The rotary motion of the rotary member 4 can stir the toner 2 to prevent clotting of the toner 2 and can also detect the amount of the toner 2. In order to detect the amount of the toner 2 in the housing 4, the rotary member 4 is coupled to the bottom end of a link 5, which has the top end thereof inserted into a vertical tube 6 at the top side of the housing 3 and fixedly provided with a magnet 7. During rotary motion of the rotary member 4, the link 5 is reciprocated in the vertical tube 6. When the link 5 reaches the upper limit position in the vertical tube 6, the magnet 7 acts with a magnet 9 at a sensor 8 inside the electronic image forming apparatus, thereby causing the sensor 8 to switch its status. By means of measuring the switched frequency of the sensor 8, the operation status and amount of the toner are known.

During installation of the aforesaid toner cartridge 1, the rotary member 4 and the link 5 must be coupled together at first, and then the rotary member 4 with the link 5 are set inside the housing 3 to have the top end of the link 5 be inserted into the vertical tube 6. This installation procedure is complicated and takes much time. Further, because the inside space of the vertical tube 6 is in communication with the inside space of the housing 3, the toner 2 tends to be forced into the inside of the vertical tube 6 during operation of the toner cartridge 1, thereby hindering normal action of the link and causing a false action of the toner cartridge 1.

SUMMARY OF THE INVENTION

The present invention has been accomplished under the circumstances in view. It is an objective of the present invention to provide a toner cartridge, which effectively prevents a false action.

It is another objective of the present invention to provide a toner cartridge, which can easily and rapidly be assembled.

To achieve these objectives of the present invention, the toner cartridge comprises a housing, which comprises a first chamber and a second chamber, a rotary member, which is mounted in the first chamber and rotatable relative to the housing by an external rotary driving force, a first magnet, which is fixedly fastened to the rotary member, an axial motion member, which is mounted in the second chamber, and a second magnet, which is fixedly provided at the bottom side of the axial motion member and adapted to act with the first magnet and to further force the axial motion member to reciprocate.

DETAILED DESCRIPTION OF THE INENTION

Figure 1:
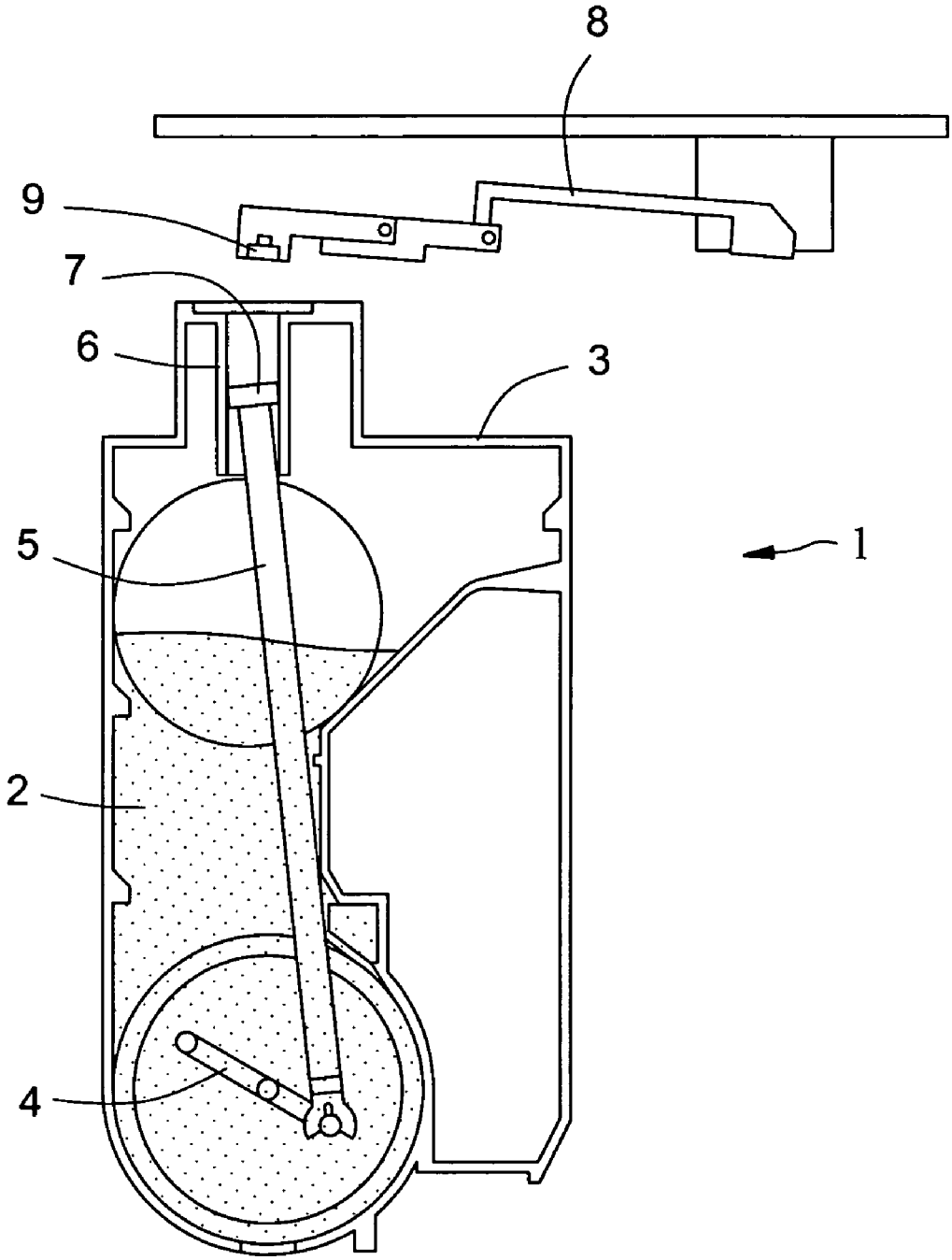
FIG. 1 PRIOR ART
FIG. 1 is a sectional view of a toner cartridge according to the prior art.
Figure 2:
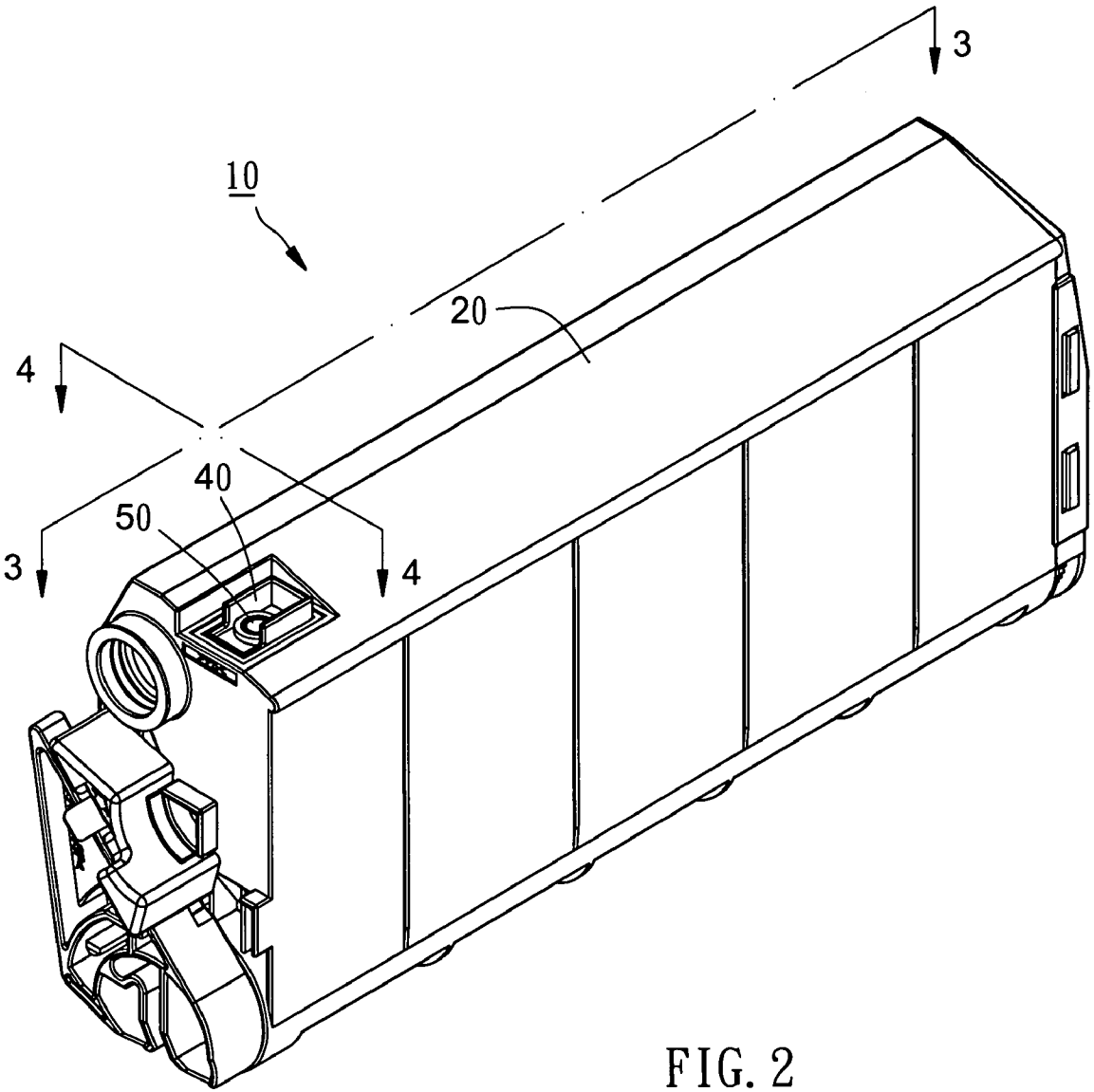
FIG. 2 is a perspective view of a toner cartridge according to the present invention.
Figure 3:
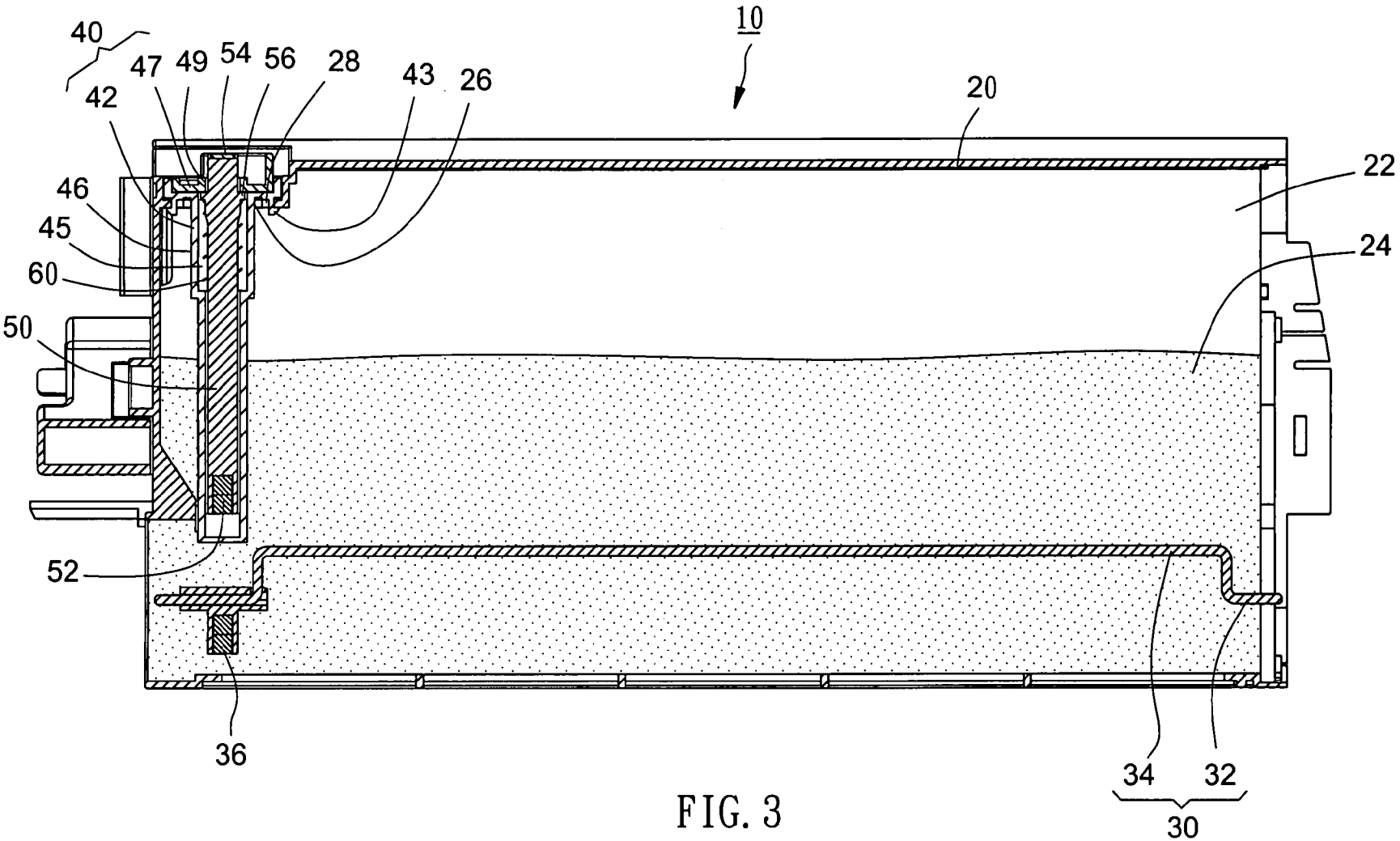
FIG. 3 is a sectional view taken along line 3—3 of FIG. 2.
Figure 4:
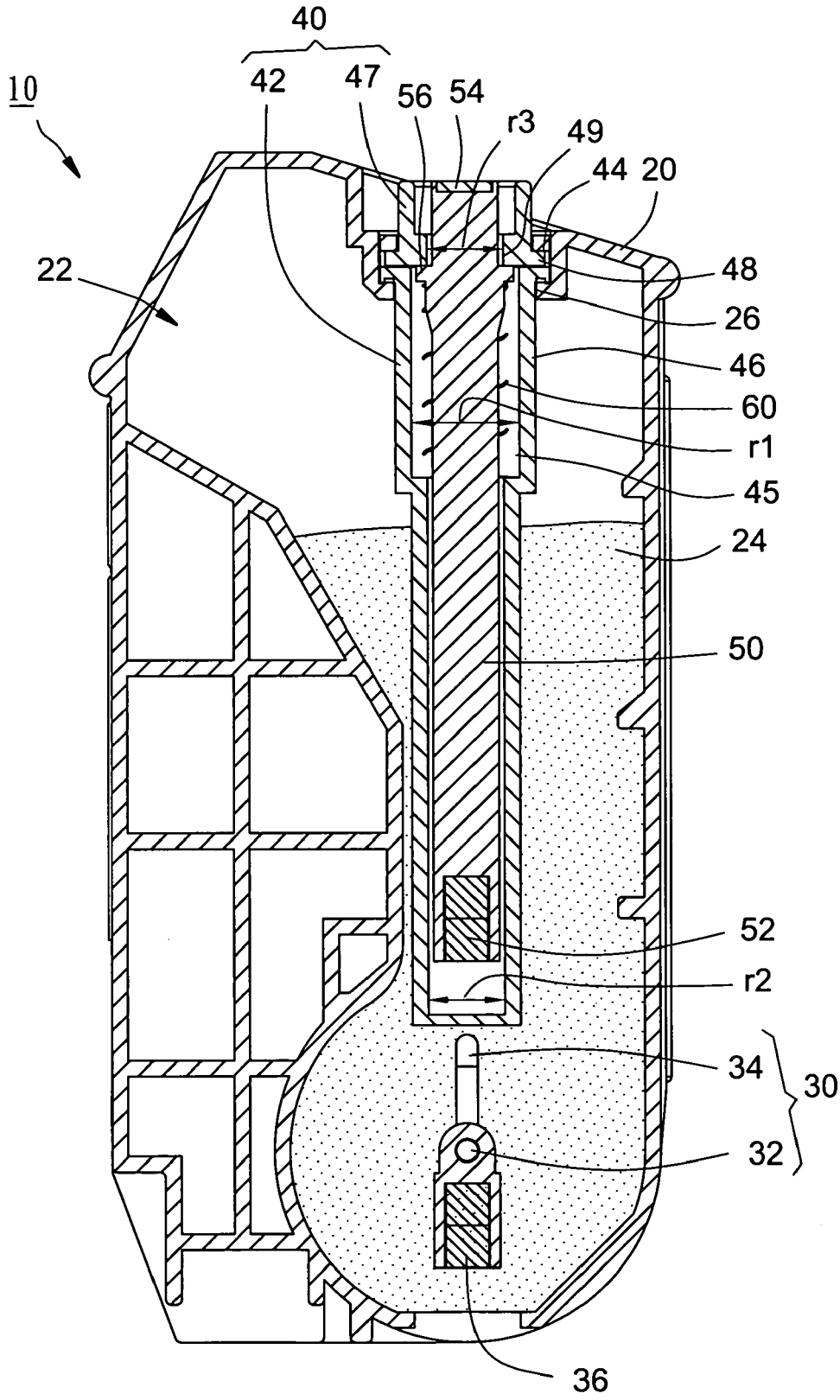
FIG. 4 is a sectional view taken along line 4—4 of FIG. 2.
Figure 5:
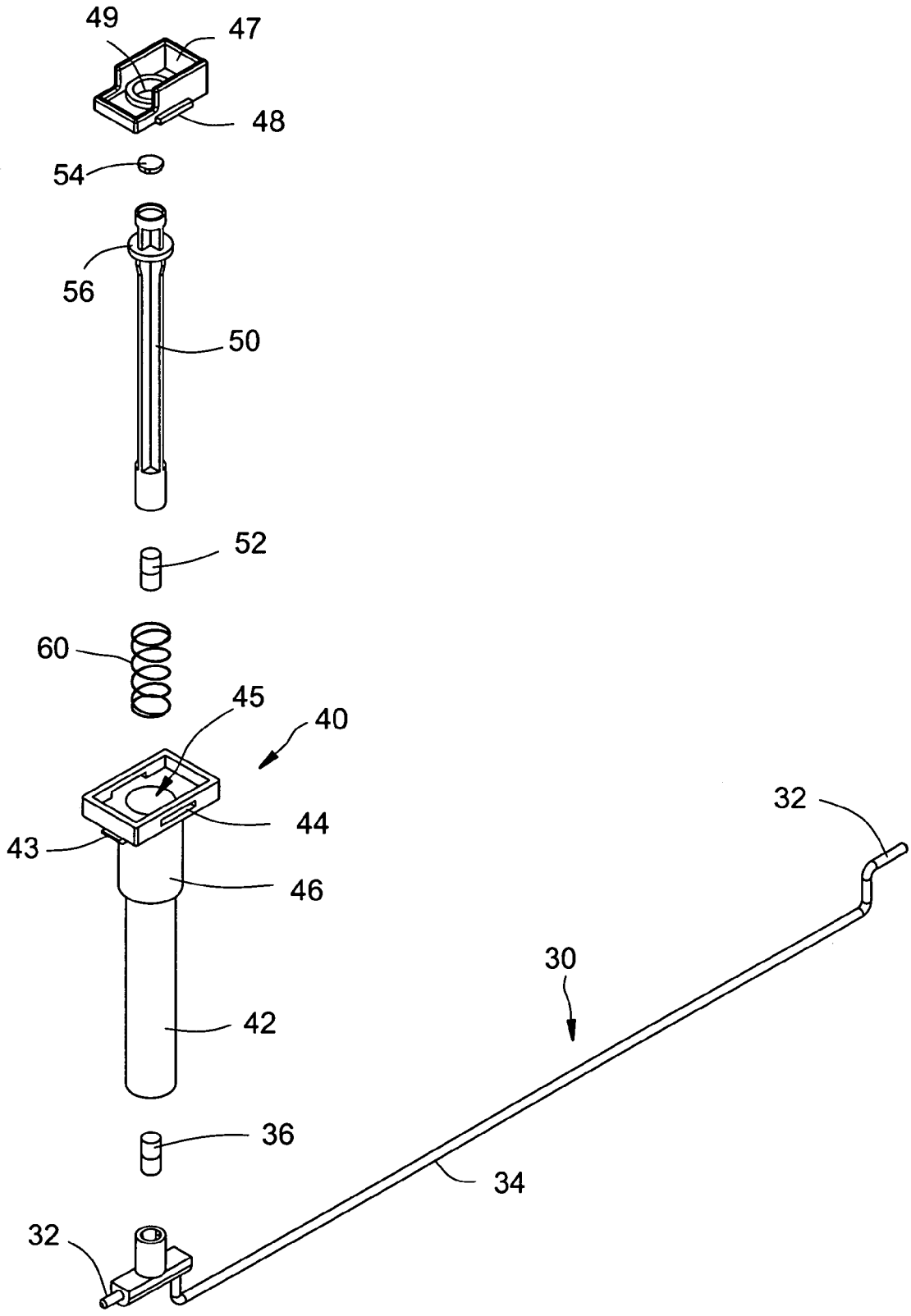
FIG. 5 is an exploded view of a part of the toner cartridge according to the present invention.

Referring to FIGS. 2–5, a toner cartridge 10 for use in an electronic image forming apparatus such as printer or copy machine according to the present invention is shown comprised of a housing 20, a rotary member 30, a barrel 40, an axial motion member 30, and a spring member 60.

The housing 20 has an accommodating chamber 22, namely the first chamber, adapted to accommodate toner 24, a through hole 26 cut through the top wall in communication between the accommodating chamber 22 and the atmosphere, and two mounting holes 28 cut through the top wall and spaced from the through hole 26 at two sides.

The barrel 40 comprises a barrel body 42 inserted through the through hole 26 of the housing 20, and a top cover 47 covering the top side of the barrel body 42. The barrel body 42 has two hooks 43 provided at the top side and respectively hooked in the mounting holes 28 of the housing 20 to secure the barrel 40 to the housing 20, two locating grooves 44 bilaterally disposed at the top, and an axially extending receiving chamber 45, namely the second chamber. The top cover 47 has two locating ribs 48 respectively engaged into the locating grooves 44 of the barrel body 42, and a through hole 49 in communication between the receiving chamber 45 and the atmosphere. Further, the barrel body 42 is a stepped cylindrical member, having a shoulder 46 neat the top. The inner diameter r1 of the shoulder 46 (the diameter of the upper part of the axially extending receiving chamber 45) is greater than the inner diameter r2 of the other part of the barrel body 42 (the lower part of the axially extending receiving chamber 45) and the inner diameter r3 of the through hole 49 of the top cover 47.

The rotary member 30 is mounted in the accommodating chamber 22 of the housing 20 and rotatable by an external rotary driving force, having two pivots 32 and a stirrer 34. The pivots 32 are pivotally coupled to the housing 20. The stirrer 34 is connected between the pivots 32 and suspending in the accommodating chamber 22 for synchronous rotation with the pivots 32 relative to the housing 20 to stir the toner 24 contained in the accommodating chamber 22. Further, a magnet 36 is fixedly provided at one pivot 32 of the rotary member 30.

The axial motion member 50 is mounted in the axially extending receiving chamber 45 of the barrel 40, having the top end thereof extending out of the through hole 49 of the top cover 47 and fixed provided with a magnet 54 adapted to attract a corresponding magnet at the electronic image forming apparatus, and the bottom end thereof fixedly provided with a magnet 52 adapted to attract the magnet 36 at the rotary member 30. The axial motion member 50 has a collar 58 set inside the shoulder 46 of the barrel body 42 of the barrel 40.

The spring member 60 is sleeved onto the axial motion member 50 and stopped between the collar 56 and the inside bottom wall of the shoulder 46 of the barrel body 42 of the barrel 40, imparting an upward pressure to the axial motion member 50.

Figure 6:
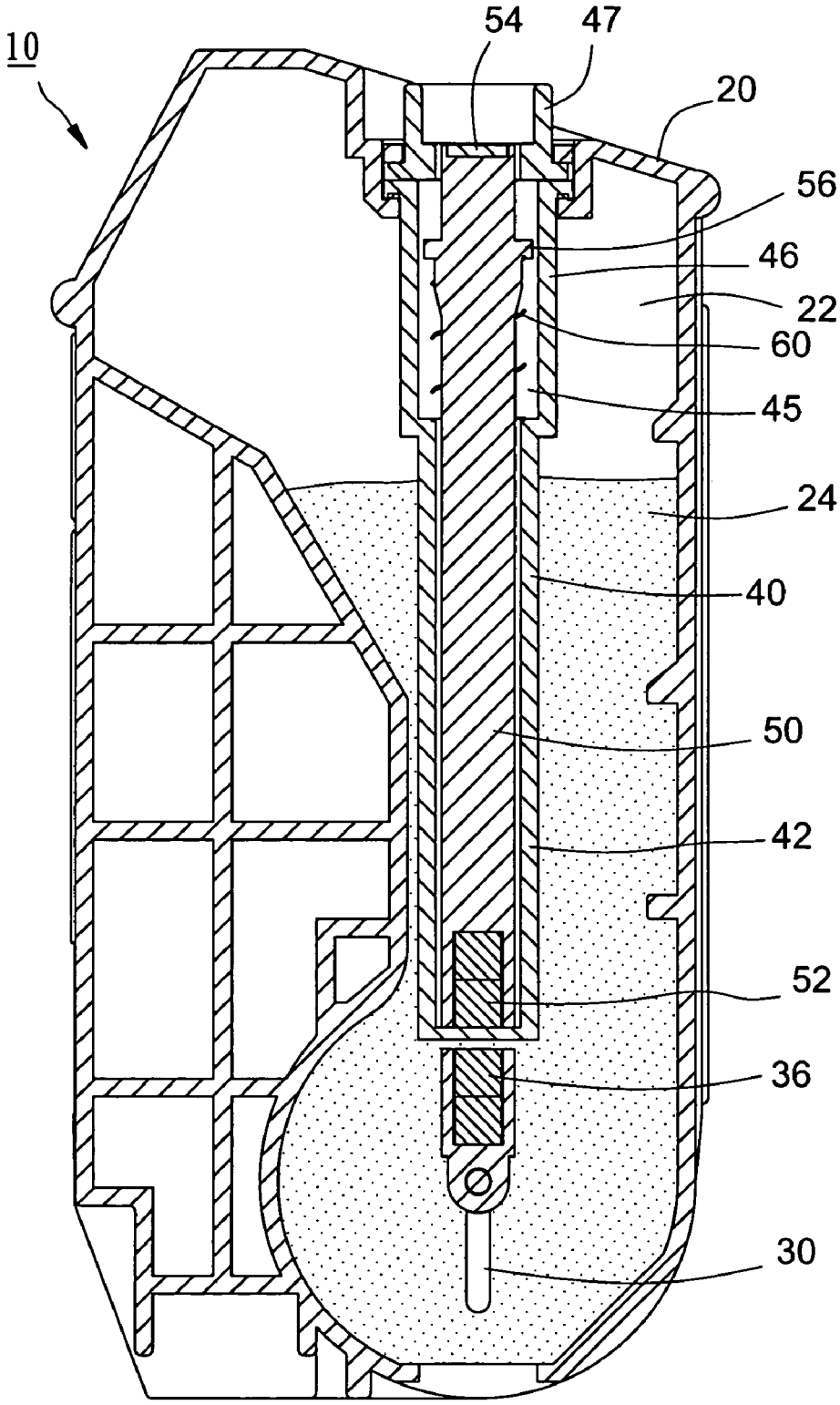
FIG. 6 is a schematic drawing of the present invention, showing the toner cartridge in action.

When an external rotary driving force rotated the rotary member 30 to the position shown in FIG. 6, the magnet 36 attracts the magnet 52 at the bottom end of the axial motion member 50, and the axial motion member 50 is moved downwards to compress the spring member 60. At this time, the magnet 54 at the top side of the axial motion member 59 is moved away from the effective range of the magnet at the electronic image forming apparatus, thereby causing the sensor of the electronic image forming apparatus to switch its status from a first operation status to a second operation status. When the rotary member 30 is rotated to the angle where the magnet 36 is beyond the attractive force of the magnet 52 at the bottom end of the axial motion member 50, the spring member 60 immediately pushes the axial motion member 50 upwards to its former position, thereby causing the magnet 54 at the top end of the axial motion member 59 to attract the magnet at the electronic image forming apparatus, and therefore the sensor of the electronic image forming apparatus is induced to switch its status from the second operation status to the first operation status.

Because the axially extending receiving chamber 45 is not in communication with the accommodating chamber 22, the toner 24 is prohibited from passing out of the accommodating chamber 22 into the axially extending receiving chamber 45 to hinder the motion of the axial motion member 50. Further, because the rotary member 30 is not coupled to the axial motion member 50 and because the axial motion member 50 is received inside the barrel 40, the assembly procedure of the present invention is simple. During the assembly procedure, the barrel 40 is inserted into the housing 20 after the axial motion member 50 has been mounted inside the barrel 40, and then the two pivots 32 of the rotary member 30 are respectively coupled to the respective pivot hole (not shown) in the housing 20. It is not necessary to couple the axial motion member 50 to the rotary member 30. This assembly procedure can easily and rapidly be done, effectively preventing a false action of the axial motion member 50. Therefore, the toner cartridge of the present invention effectively eliminates the drawbacks of the prior art design, achieving the desired objects.

Further, the location of the magnet 36 is not limited to one pivot 32 of the rotary member 30. It can be fastened to the rotary member 30 at any location where the magnet 36 is rotatable with the rotary member 30 about the axis of the rotary member 30. The magnet 52 at the bottom side of the barrel 50 and the magnet 36 at the rotary member 30 can be made to produce a magnetic repelling force. In this case, the aforesaid spring member 60 can be eliminated, and the barrel 50 is normally positioned in the position shown in FIG. 6 by means of the effect of the gravity of the barrel 50. When the magnet 36 approaching the magnet 52, the magnetic repelling force between the two magnets 36, 52 overcomes the gravity weight of the barrel 50, thereby forcing the barrel 50 out of the through hole 49 to act with the sensor at the electronic image forming apparatus. The magnet 54 at the top side of the barrel 50 may be eliminated in practice, allowing the axial motion member 50 to directly mechanically touch the sensor, causing the sensor to switch its operation status. The top cover 47 can be made without the through hole 49, allowing the field force (magnetic force) between the magnet 54 at the top side of the barrel 50 and the magnet at the sensor of the electronic image forming apparatus to achieve the action of driving the sensor to switch its operating status.

Figure 7:
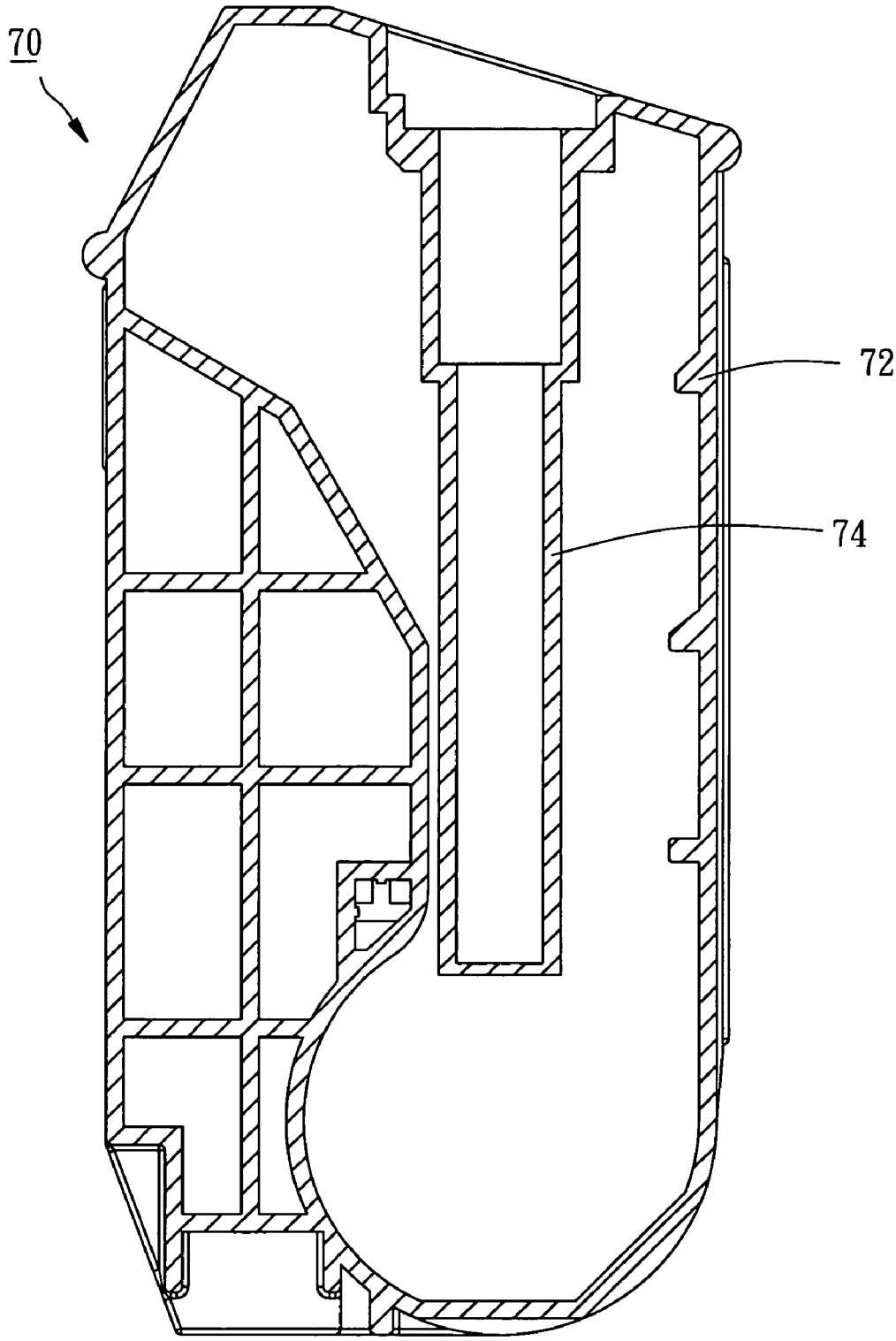
FIG. 7 is a sectional view of an alternate form of the present invention.

FIG. 7 shows a toner cartridge 70 according to the second embodiment of the present invention. According to this embodiment, the barrel 74 is formed integral with the housing 72. Further, the barrel 74 can be made having a circuit or rectangular cross section, or a cross section of any of a variety of shapes.

What is claimed is:

1. A toner cartridge comprising:

a housing having a first chamber and a second chamber;

a rotary member mounted in said first chamber and rotatable relative to said housing by an external rotary driving force;

a first magnet fixedly fastened to said rotary member;

an axial motion member mounted in said second chamber; and a second magnet fixedly provided at a bottom side of said axial motion member for acting with said first magnet to further force said axial motion member to reciprocate.

2. The toner cartridge as claimed in claim 1, wherein said rotary member comprises two pivots respectively pivoted to said housing, and a stirrer connected between said pivots; said first magnet is fastened to one of said pivots.

3. The toner cartridge as claimed in claim 1, further comprising a barrel mounted in said first chamber and defining therein said second chamber.

4. The toner cartridge as claimed in claim 3, wherein said barrel comprises a shoulder surrounding an upper part of said second chamber; said axial motion member has a collar set inside said shoulder; the toner cartridge further comprises a spring member sleeved onto said axial motion member and stopped between said collar and an inside bottom wall of said shoulder.

5. The toner cartridge as claimed in claim 3, wherein said barrel has a through hole in a top side thereof; said axial motion member has a top end movable in and out of the through hole of said barrel during reciprocating motion of said motion member.

6. The toner cartridge as claimed in claim 1, further comprising a third magnet fixedly provided at a top side of said axial motion member.

7. The toner cartridge as claimed in claim 1, wherein said first magnet and said second magnet are attractable to each other.

8. The toner cartridge as claimed in claim 1, wherein said first magnet and said second magnet are magnetically expulsive to each other.

* * * * *